US009656384B1

(12) United States Patent
Tsai

(10) Patent No.: US 9,656,384 B1
(45) Date of Patent: May 23, 2017

(54) TOOLBOX

(71) Applicant: Sheng-Feng Tsai, Taichung (TW)

(72) Inventor: Sheng-Feng Tsai, Taichung (TW)

( * ) Notice: Subject to any disclaimer, the term of this patent is extended or adjusted under 35 U.S.C. 154(b) by 0 days.

(21) Appl. No.: 15/351,516

(22) Filed: Nov. 15, 2016

(30) Foreign Application Priority Data

Apr. 11, 2016 (TW) ..... 105204966 U

(51) Int. Cl.
*B65D 85/28* (2006.01)
*B25H 3/00* (2006.01)
*B65D 25/10* (2006.01)

(52) U.S. Cl.
CPC ..... *B25H 3/003* (2013.01); *B65D 25/108* (2013.01)

(58) Field of Classification Search
CPC ..... B25H 3/003; B25H 3/02; B65D 25/108; B65D 85/28
USPC ..... 206/349, 372, 373, 374, 375, 376, 377, 206/378, 379
See application file for complete search history.

(56) References Cited

U.S. PATENT DOCUMENTS 5,535,882 A * 7/1996 Liu ..... B25H 3/003 206/376
5,803,254 A * 9/1998 Vasudeva ..... B25H 3/023 206/373
5,829,596 A * 11/1998 Budert ..... B25H 3/003 206/349
6,283,291 B1 * 9/2001 Vasudeva ..... B25H 3/003 206/373
6,626,295 B1 * 9/2003 Vasudeva ..... B25H 3/023 206/373
7,931,143 B1 * 4/2011 Lin ..... B25H 3/003 206/373
9,486,912 B1 * 11/2016 Chen ..... B25H 3/02
2004/0200749 A1 * 10/2004 Wang ..... B25H 3/003 206/373
2005/0241974 A1 * 11/2005 Chen ..... B25H 3/003 206/379
2009/0266730 A1 * 10/2009 Lin ..... B25H 3/003 206/372
2016/0052125 A1 * 2/2016 Steele ..... B25H 3/003 206/372

* cited by examiner

*Primary Examiner* — Jacob K Ackun
*Assistant Examiner* — Rafael Ortiz
(74) *Attorney, Agent, or Firm* — Charles E. Baxley

(57) ABSTRACT

A toolbox includes a body having multiple recesses defined in each of two facing insides thereof, and a groove is defined in each of the two facing insides of the body and located above the recesses. At least one bit receiving unit is pivotably connected to the body by pivotably engaging two pivots on two ends of the bit receiving unit with the recesses of the two facing insides. Two protrusions extend from each of the two ends of the at least one bit receiving unit and are located above the pivot corresponding thereto. When the bit receiving unit is pivoted upward, the protrusions are engaged with the grooves of the two facing insides of the toolbox so that the bit receiving unit is well positioned. When the bit receiving unit is positioned horizontally, the protrusions are engaged with the recesses of the two facing insides of the toolbox.

4 Claims, 6 Drawing Sheets

TOOLBOX

BACKGROUND OF THE INVENTION

1. Fields of the Invention

The present invention relates to a toolbox to which bit receiving units are pivotably connected, the bit receiving units are positioned when they are pivoted upright.

2. Descriptions of Related Art

The conventional toolbox generally includes multiple notches and bits or small hand tools are received in the notches. However, the bits and hand tools randomly moves in the toolbox when carrying the box from one place to another. The users have to take time to choose the desired ones.

Some toolboxes are equipped with bit receiving units which provides proper shapes of holes for positioning the bits and the hand tools. The receiving units can be pivoted for convenience of pick-up for the users. Nevertheless, the bit receiving units are simply connected to the toolbox by a pivot, and the bit receiving units are not well secured and can be pivoted when the toolbox moves. The bits and hand tools drop from the bit receiving units when the bit receiving units pivot.

The present invention intends to provide a toolbox and a bit receiving unit, wherein the receiving unit for receiving bits and hand tools is positioned when it is pivoted upright in the toolbox.

SUMMARY OF THE INVENTION

The present invention relates to a toolbox and comprises a body having multiple recesses defined in each of two facing insides thereof. A groove is defined in each of the two facing insides of the body and located above the recesses. At least one bit receiving unit is pivotably connected to the body and includes a case which has multiple insertion holes for receiving bits therein. A pivot extends from each of two ends of the at least one bit receiving unit. The at least one bit receiving unit is pivotably connected between the two facing insides of the body by pivotably engaging the two pivots with the recesses of the two facing insides. At least two protrusions extend from each of the two ends of the at least one bit receiving unit and are located above the pivot corresponding thereto.

Preferably, the case has multiple resilient plates which extend from the bottom of the case and each resilient plate has a free end located close to a top of the case. The resilient plates are respectively located corresponding to the insertion holes.

Preferably, each of the resilient plates has a boss extending from the inside thereof.

Preferably, the insertion holes are circular holes or hexagonal holes.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
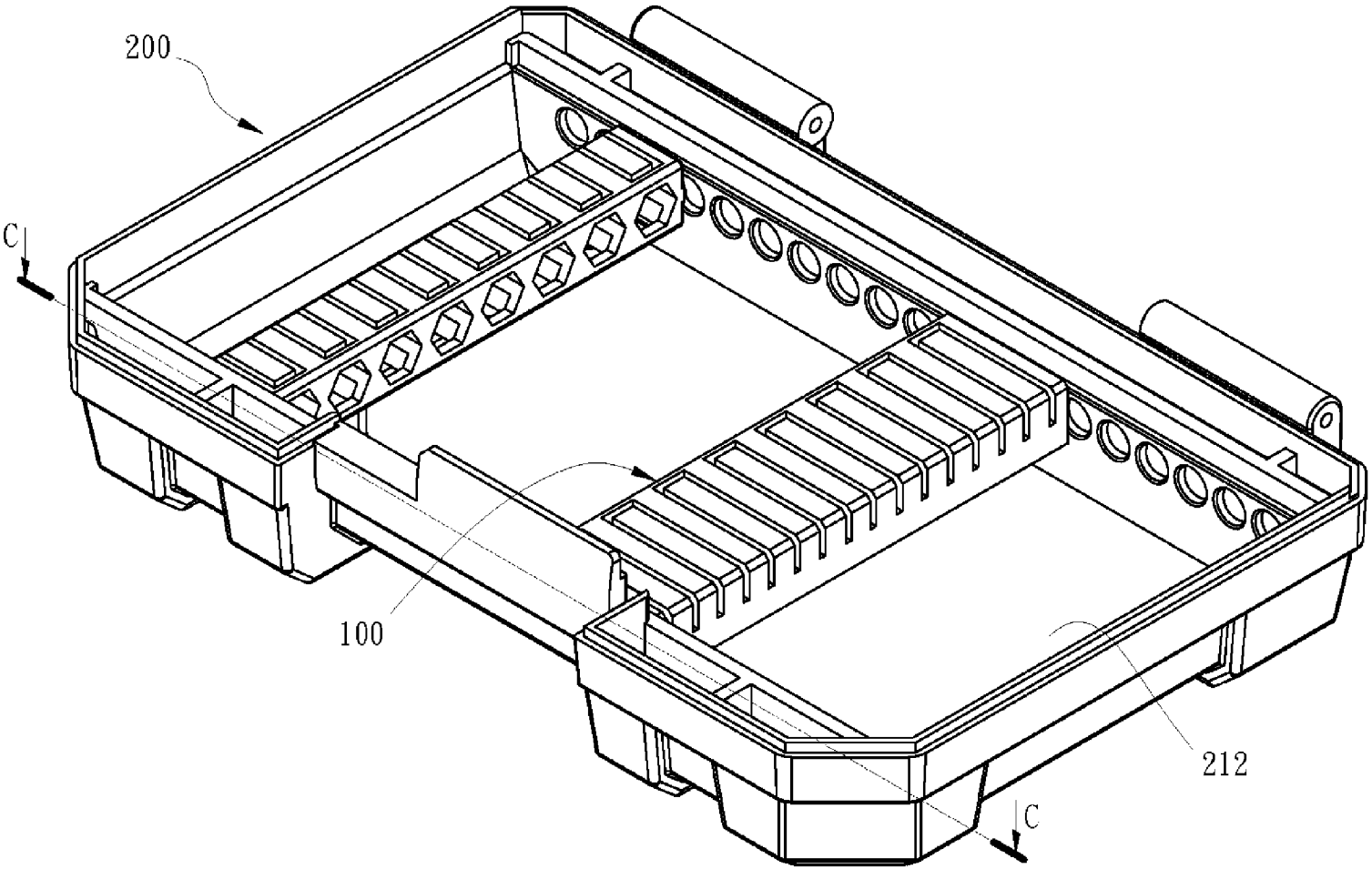
FIG. 1 is a perspective view to show the tool box of the present invention.
Figure 2:
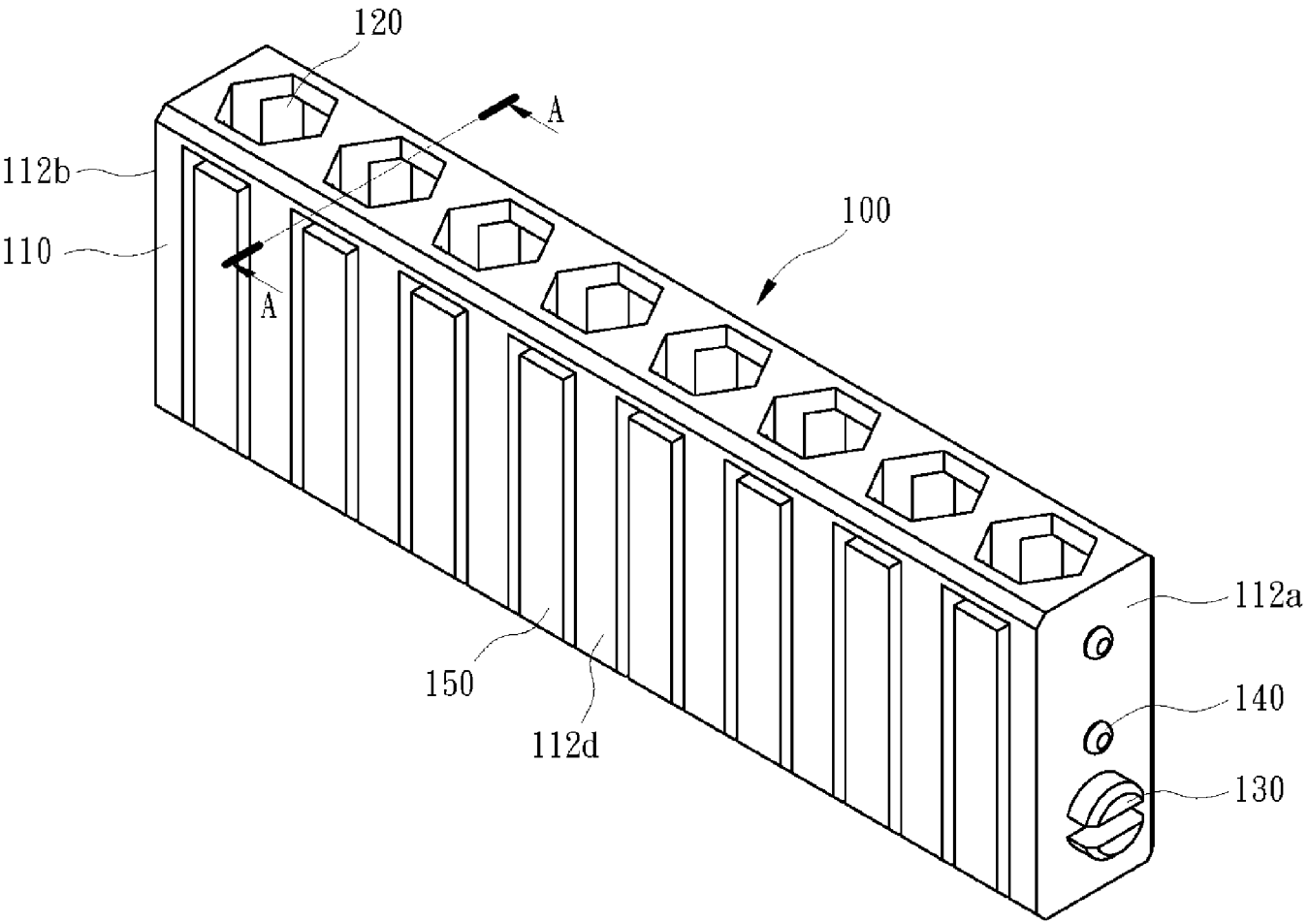
FIG. 2 is a perspective view to show the bit receiving unit to be received in the tool box of the present invention.
Figure 3:
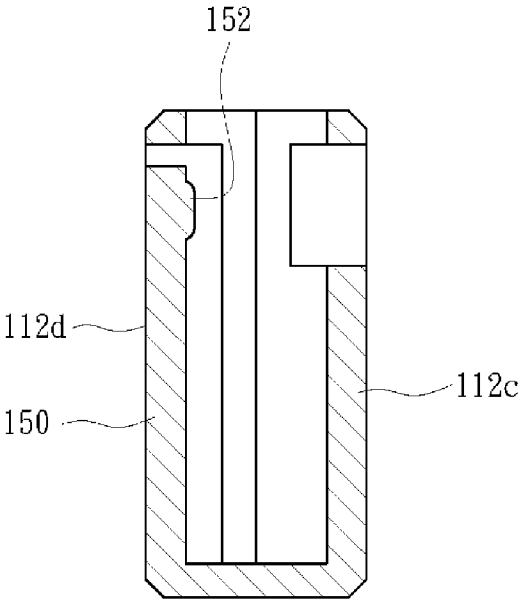
FIG. 3 is an end cross sectional view, taken along line A-A in FIG. 2.

Referring to FIGS. 1 to 3, the A toolbox 200 of the present invention comprises a body 210 having multiple recesses 216 defined in each of two facing insides 214*a*, 214*b* thereof. An elongate groove 218 is defined in each of the two facing insides 214*a*, 214*b* of the body 210 and located above the recesses 216. At least one room 212 is defined in the body 210. The toolbox 200 can be composed of the body 210 and a cover which is not shown. The body 210 and the cover can be made individually or made as a one-piece.

At least one bit receiving unit 100 is received in the at least one room 212 and pivotably connected to the body 210. In this embodiment, there are two bit receiving units 100 and each bit receiving units 100 comprises a case 110. The case 110 has multiple insertion holes 120 defined therein. The insertion holes 120 are circular holes or hexagonal holes so as to receive bits therein. A pivot 130 extends from each of two ends 112*a*, 112*b* of the each of the bit receiving units 100, such that the bit receiving unit 100 is pivotably connected between the two facing insides 214*a*, 214*b* of the body 210 by pivotably engaging the two pivots 130 with the recesses 216 of the two facing insides 214*a*, 214*b*. Two protrusions 140 extend from each of the two ends 112*a*, 112*b* of each of the bit receiving units 100 and are located above the pivot 130 corresponding thereto.

Figure 4:
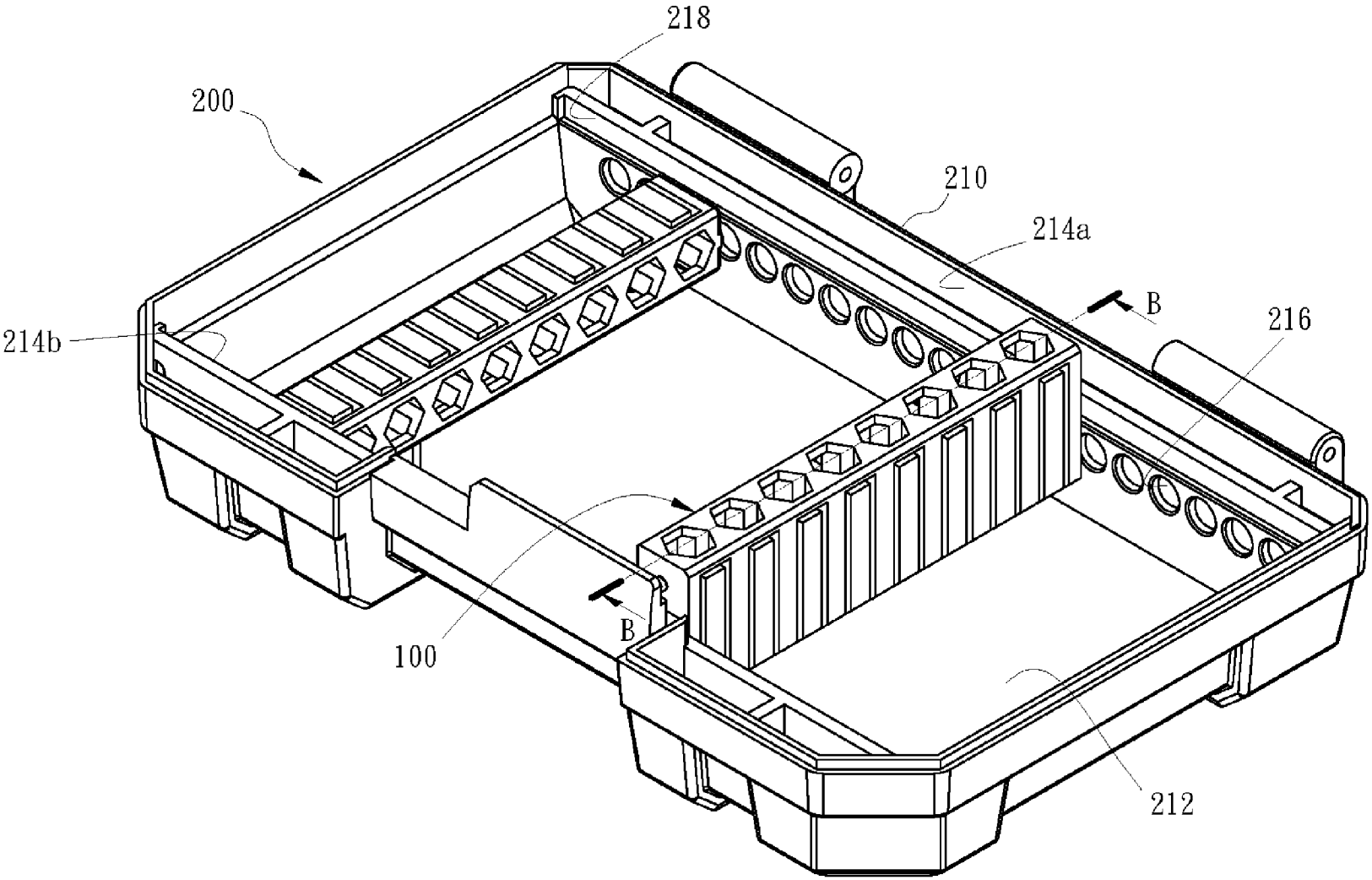
FIG. 4 is a perspective view to show that the bit receiving unit is pivoted upright in the tool box of the present invention.
Figure 5:
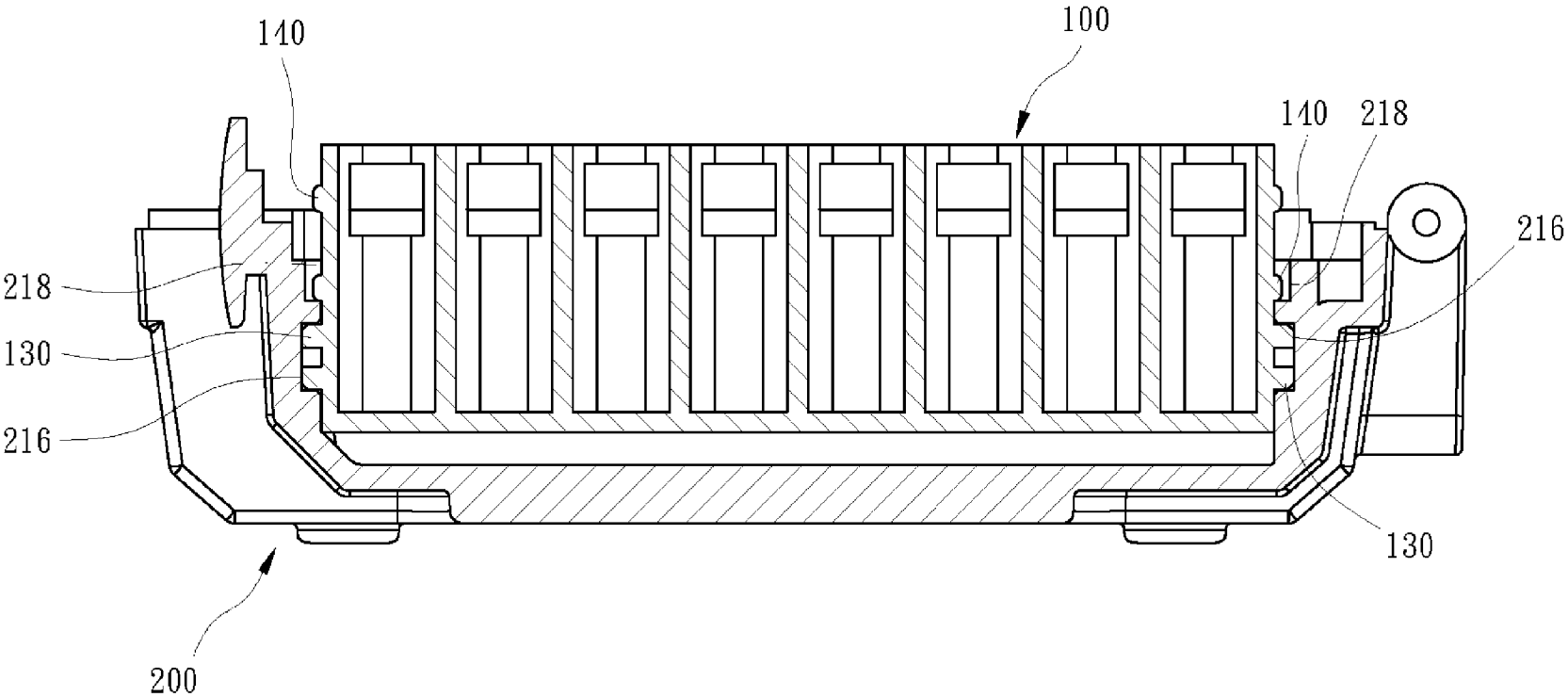
FIG. 5 is a cross sectional view, taken along line B-B in FIG. 4.

The case 110 has multiple resilient plates 150 which extend from the bottom of the case 110, and each resilient plate 150 has a free end that is located close to the top of the case 110. In other words, the free ends of the resilient plates 150 are not connected to the top of the case 110 and can be resiliently moved outward. The resilient plates 150 are respectively located corresponding to the insertion holes 120. Each of the resilient plates 150 has a boss 152 extending from the inside thereof. When inserting a bit into the insertion hole 120, the bit pushes the boss 152 together with the resilient plate 150 outward so that the insertion hole 120 is opened wide and the bit is inserted into the insertion hole 120. The case 110 can be positioned horizontally as shown in FIGS. 1 and 6, or the case 110 can be pivoted upright as shown in FIGS. 4 and 5.

Figure 6:
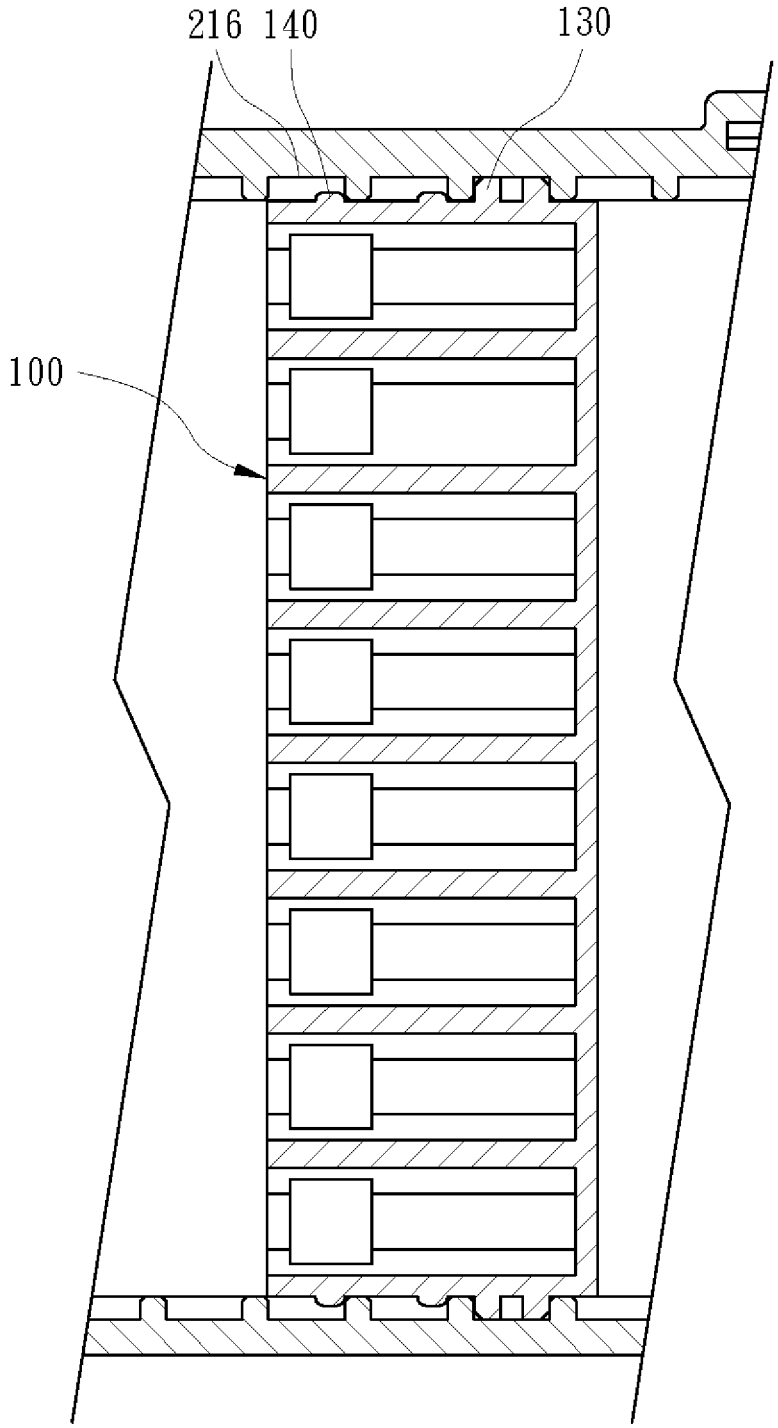
FIG. 6 is a cross sectional view, taken along line C-C in FIG. 1.

As shown in FIGS. 1 and 6, when the bit receiving unit 100 is located horizontally, the protrusions 140 are engaged with the recesses 216 so that the bit receiving unit 100 is well positioned. As shown in FIGS. 4 and 5, when the bit receiving unit 100 is pivoted upright, the bit receiving unit 100 is pivoted about the pivots 130 and the protrusions 140 are engaged with the groove 218. By the arrangement, the bit receiving unit 100 is well positioned at the horizontal position and the upright position. When users pick the bits from the bit receiving unit 100 that is positioned upright, the bit receiving unit 100 does not move.

When the bit receiving unit 100 is pivoted downward, the bit receiving unit 100 is pivoted about the pivots 130 and the protrusions 140 are disengaged from the groove 218 and engaged with the recesses 216 to be positioned.

The bit receiving unit 100 is secured when the tool box 200 moves or even upside down. The number of the protrusions 140 can be varied according to height of the bit receiving unit 100.

While we have shown and described the embodiment in accordance with the present invention, it should be clear to those skilled in the art that further embodiments may be made without departing from the scope of the present invention.

What is claimed is:

1. A toolbox comprising:

a body having multiple recesses defined in each of two facing insides thereof, a groove defined in each of the two facing insides of the body and located above the recesses, and at least one bit receiving unit pivotably connected to the body and comprising a case, the case having multiple insertion holes defined therein, a pivot extending from each of two ends of the at least one bit receiving unit, the at least one bit receiving unit pivotably connected between the two facing insides of the body by pivotably engaging the two pivots with the recesses of the two facing insides, at least two protrusions extending from each of the two ends of the at least one bit receiving unit and located above the pivot corresponding thereto.

2. The toolbox as claimed in claim 1, wherein the case has multiple resilient plates which extend from a bottom of the case and each resilient plate has a free end located close to a top of the case, the resilient plates are respectively located corresponding to the insertion holes.

3. The toolbox as claimed in claim 2, wherein each of the resilient plates has a boss extending from an inside thereof.

4. The toolbox as claimed in claim 1, wherein the insertion holes are circular holes or hexagonal holes.

* * * * *